US011506345B2

(12) United States Patent
Jeong

(10) Patent No.: US 11,506,345 B2
(45) Date of Patent: Nov. 22, 2022

(54) LAMP FOR AUTOMOBILE AND AUTOMOBILE INCLUDING THE SAME

(71) Applicant: HYUNDAI MOBIS CO., LTD., Seoul (KR)

(72) Inventor: Seok Ho Jeong, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/476,506

(22) Filed: Sep. 16, 2021

(65) Prior Publication Data

US 2022/0128201 A1 Apr. 28, 2022

(30) Foreign Application Priority Data

Oct. 26, 2020 (KR) ..... 10-2020-0139708

(51) Int. Cl.

| | |
|---|---|
| ***F21K 9/278*** | (2016.01) |
| ***F21S 43/27*** | (2018.01) |
| ***F21V 5/04*** | (2006.01) |
| ***F21S 43/16*** | (2018.01) |
| ***F21S 41/176*** | (2018.01) |
| ***F21Y 103/10*** | (2016.01) |

(52) U.S. Cl.

CPC ..... *F21K 9/278* (2016.08); *F21S 41/176* (2018.01); *F21S 43/16* (2018.01); *F21S 43/27* (2018.01); *F21V 5/04* (2013.01); *F21Y 2103/10* (2016.08)

(58) Field of Classification Search

CPC ..... F21S 43/16

See application file for complete search history.

(56) References Cited

U.S. PATENT DOCUMENTS

| | | | | |
|---|---|---|---|---|
| 5,490,049 | A * | 2/1996 | Montalan | B60Q 1/2696 362/240 |
| 9,896,023 | B1 * | 2/2018 | Salter | F21S 43/255 |
| 10,081,295 | B2 * | 9/2018 | Dellock | G09F 13/22 |
| 10,300,843 | B2 * | 5/2019 | Abdelnour | F21S 43/235 |
| 10,723,257 | B2 * | 7/2020 | Salter | B60Q 1/28 |
| 10,760,745 | B2 * | 9/2020 | Einig | F21V 9/00 |
| 2009/0129107 | A1 * | 5/2009 | Egerer | B60Q 3/64 362/509 |
| 2013/0329445 | A1 * | 12/2013 | Oh | F21S 43/19 362/543 |
| 2015/0138820 | A1 * | 5/2015 | Salter | B60Q 3/82 362/510 |
| 2017/0240100 | A1 * | 8/2017 | Salter | B60Q 1/0011 |
| 2019/0234581 | A1 * | 8/2019 | Iwakura | F21S 41/176 |

* cited by examiner

*Primary Examiner* — William N Harris

(74) *Attorney, Agent, or Firm* — DLA Piper LLP (US)

(57) ABSTRACT

A lamp for an automobile and the automobile. A lamp for an automobile includes: a substrate part; a plurality of light sources provided in close contact with a top surface of the substrate part and configured to emit light; a fluorescent layer spaced upward from the substrate part and the plurality of light sources and including a fluorescent material; and an inner lens provided in close contact with a top surface or a bottom surface of the fluorescent layer.

11 Claims, 6 Drawing Sheets

LAMP FOR AUTOMOBILE AND AUTOMOBILE INCLUDING THE SAME

CROSS-REFERENCE TO RELATED APPLICATION(S)

This application claims priority from and the benefit of Korean Patent Application No. 10-2020-0139708, filed on Oct. 26, 2020, which is hereby incorporated by reference for all purposes as if set forth herein.

TECHNICAL FIELD

Exemplary embodiments relate to a lamp for an automobile and an automobile including the lamp.

BACKGROUND

Various types of lamps are mounted to an automobile. For example, rear lamps such as tail lamps, stop lamps, and turn signal lamps may be provided on the rear of the automobile.

Meanwhile, a direct lighting method, in which light is directly emitted to the outside through an inner lens provided in front of light sources without using a separate reflector, and an indirect lighting method, in which light is emitted to the outside after being reflected from a reflector, are mainly used in lamps mounted to the automobile.

However, in lamps for an automobile according to the related art, it is required to form an air gap having a predetermined space. In addition, an inner lens not only serving as an reflection layer but performing a light diffusing function is required.

Thus, according to the related art, there are many spatial limitations in mounting the lamps to the automobile.

Also, according to the related art, due to the presence of the air gap and the inner lens described above, it is difficult to satisfy various regulations on the lamps for an automobile even while applying various types of design to the lamps.

SUMMARY

Exemplary embodiments of the present invention provide for manufacturing a lamp for an automobile, capable of satisfying various regulations required for the lamp even while achieving a more compact size and applying various types of design compared to the related art.

A first exemplary embodiment of the present invention provides a lamp for an automobile, the lamp including: a substrate part; a plurality of light sources provided in close contact with a top surface of the substrate part and configured to emit light; a fluorescent layer spaced upward from the substrate part and the plurality of light sources and including a fluorescent material; and an inner lens provided in close contact with a top surface or a bottom surface of the fluorescent layer.

The inner lens may be bonded to the top surface of the fluorescent layer.

The inner lens may be bonded to the bottom surface of the fluorescent layer.

The fluorescent layer may further include a resin matrix, wherein the fluorescent material is dispersed within the resin matrix.

A peak wavelength of light emitted from the fluorescent layer may be greater than a peak wavelength of the light emitted from the plurality of light sources.

The light sources may be exposed to the outside.

A plurality of first protruding regions may be provided on an upper region of the inner lens.

A plurality of second protruding regions may be provided on a lower region of the inner lens.

The plurality of second protruding regions may face the plurality of light sources, respectively.

The lamp may further include an outer lens provided above the fluorescent layer and the inner lens, wherein the outer lens blocks a portion of a wavelength of visible light emitted from the fluorescent layer or the inner lens.

Each of the substrate part, the fluorescent layer, the inner lens, and the outer lens may have a curved shape in which a central region thereof protrudes outward.

The lamp may further include a bezel part provided in a circumferential region on the substrate part, wherein the bezel part is provided such that the substrate part interferes with the bezel part when the substrate part moves outward.

A second exemplary embodiment of the present invention provides an automobile including a lamp for the automobile, wherein the lamp includes: a substrate part; a plurality of light sources provided in close contact with a top surface of the substrate part and configured to emit light; a fluorescent layer spaced upward from the substrate part and the plurality of light sources and including a fluorescent material; and an inner lens provided in close contact with a top surface or a bottom surface of the fluorescent layer.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for an automobile and the automobile according to the present disclosure will be described with reference to the drawings.

Lamp for Automobile

Figure 1:
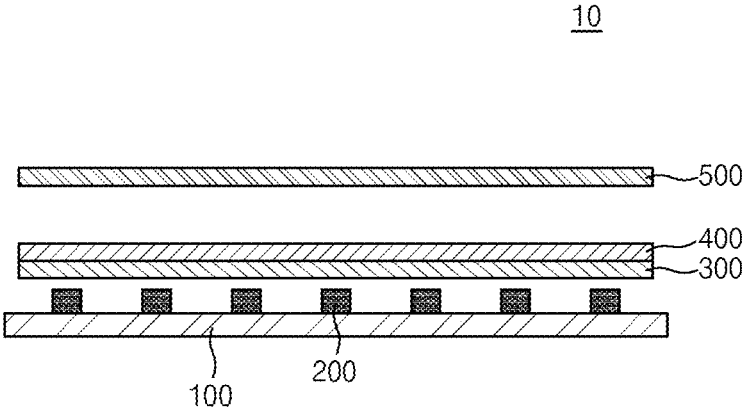
FIG. 1 is a cross-sectional view schematically illustrating a structure of a lamp for an automobile according to a first exemplary embodiment of the present disclosure.
Figure 2:
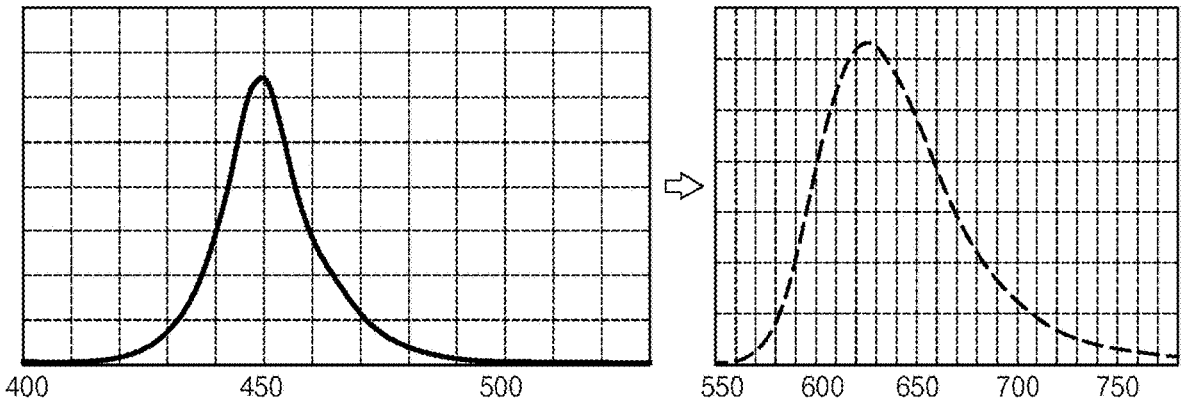
FIG. 2 is a graph showing an example in which a wavelength of light is changed by a fluorescent layer of a lamp for an automobile according to the present disclosure.
Figure 3:
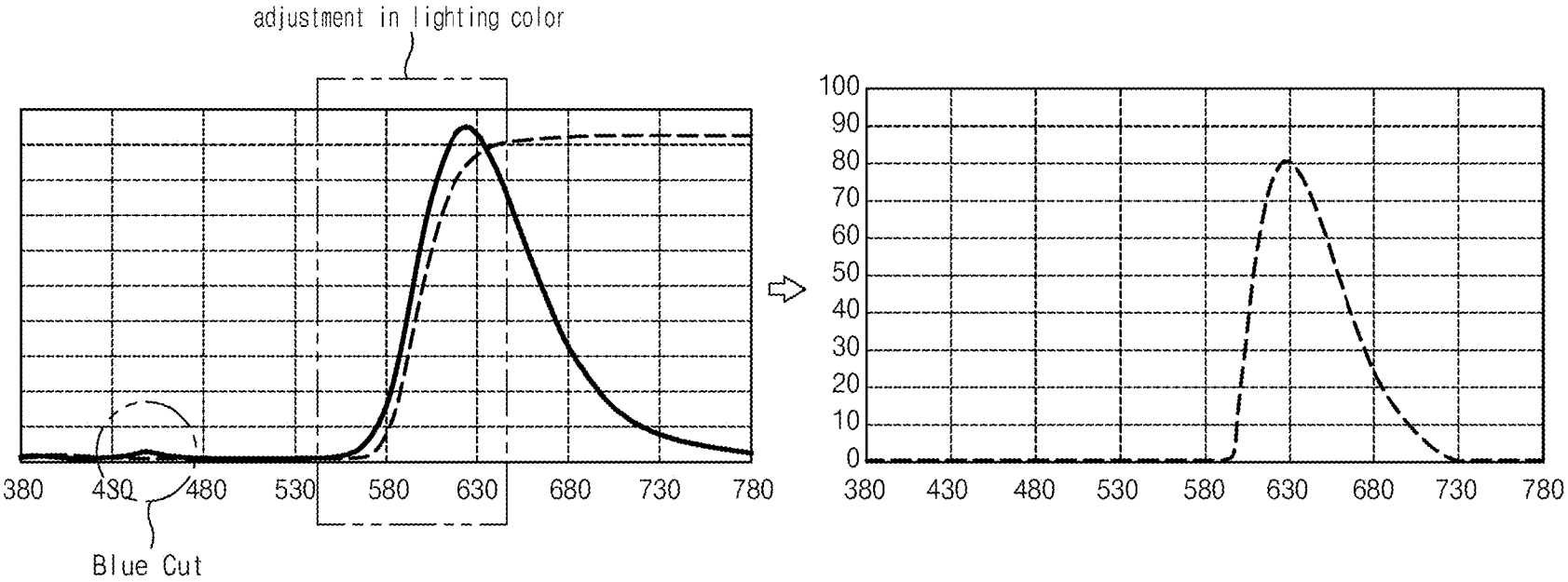
FIG. 3 is a graph showing an example in which a portion of a wavelength of light is blocked by an outer lens of a lamp for an automobile according to the present disclosure.

FIG. 1 is a cross-sectional view schematically illustrating a structure of a lamp for an automobile according to a first exemplary embodiment of the present disclosure, and FIG. 2 is a graph showing an example in which a wavelength of light is changed by a fluorescent layer of a lamp for an automobile according to the present disclosure. Also, FIG. 3 is a graph showing an example in which a portion of a wavelength of light is blocked by an outer lens of a lamp for an automobile according to the present disclosure.

As illustrated in FIG. 1, a lamp 10 for an automobile (hereinafter, referred to as a 'lamp') according to the present disclosure may include a substrate part 100 and a light source 200 provided in close contact with a top surface of the substrate part 100 and emitting light. The substrate part 100 may be a printed circuit board (PCB). For example, the substrate part 100 may be a flexible printed circuit board. The thickness of the substrate part 100 may be about 0.05 mm to about 5 mm, or about 0.1 mm to about 1 mm. Meanwhile, the light source 200 may be provided in plurality. For example, the light sources 200 may be a blue chip size package (CSP). For example, the light sources 200 may be attached to the top surface of the substrate part 100.

Also, the lamp 10 may include a fluorescent layer 300 spaced upward from the substrate part 100 and the plurality of light sources 200. The fluorescent layer 300 may include a resin matrix and a fluorescent material dispersed within the resin matrix.

According to the present disclosure, the fluorescent layer 300 may be configured to receive the light emitted from the plurality of light sources 200 and then emit light which has a wavelength different from a wavelength of the light emitted from the plurality of light sources 200. Thus, the fluorescent layer 300 may be a component that changes the wavelength of the light emitted from the plurality of light sources 200 and then emits the light to the outside.

Here, according to the present disclosure, a peak wavelength of the light emitted from the fluorescent layer 300 may be greater than a peak wavelength of the light emitted from the plurality of light sources 200. For example, the light emitted from the plurality of light sources 200 may have a peak wavelength of about 420 nm to about 470 nm, and the light emitted from the fluorescent layer 300 may have a peak wavelength of about 600 nm to about 650 nm. FIG. 2 illustrates, as one example, a state in which the light having a peak wavelength of about 450 nm is changed into the light having a peak wavelength of about 625 nm after passing through the fluorescent layer 300.

Continuing to refer to FIG. 1, the lamp 10 according to the present disclosure may include an inner lens 400 provided in close contact with the top surface or the bottom surface of the fluorescent layer 300. According to the present disclosure, the inner lens 400 is provided in close contact with the top surface or the bottom surface of the fluorescent layer 300, and thus, the volume occupied by the lamp 10 may be reduced as much as possible.

Meanwhile, as illustrated in FIG. 1, the plurality of light sources 200 may be exposed to the outside. That the plurality of light sources 200 are exposed to the outside may represent that the plurality of light sources 200 are not buried in another component but exposed to the outside air. More preferably, at least light emitting surfaces of the plurality of light sources 200 may be exposed to the outside.

Meanwhile, as one example, the distance between one of the fluorescent layer 300 or the inner lens 400 adjacent to the light sources 200 and the substrate part 100 in which the plurality of light source 200 are provided may be about 2 mm. However, the protective scope of the present disclosure is not limited to the above-described numerical range.

Also, according to the present disclosure, the lamp 10 may further include an outer lens 500 provided above the fluorescent layer 300 and the inner lens 400. Here, the outer lens 500 may be a component that changes color of the light emitted to the outside by blocking a portion of a wavelength of visible light emitted from the fluorescent layer 300 or the inner lens 400. For example, the outer lens 500 may block blue light present between about 430 nm and about 480 nm as illustrated in FIG. 3, thus reducing visual stimulus as much as possible when the lamp 10 is viewed from the outside.

Figure 4:
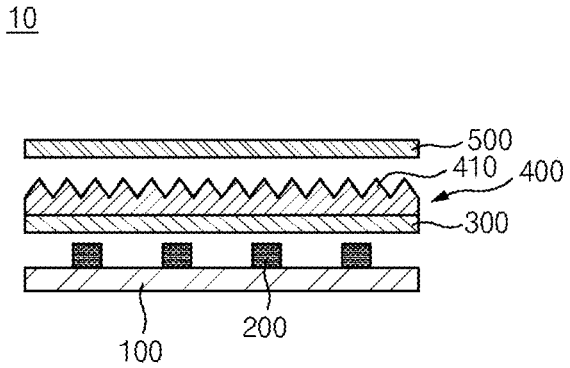
FIG. 4 is a cross-sectional view schematically illustrating a structure of a lamp for an automobile according to a second exemplary embodiment of the present disclosure.
Figure 5:
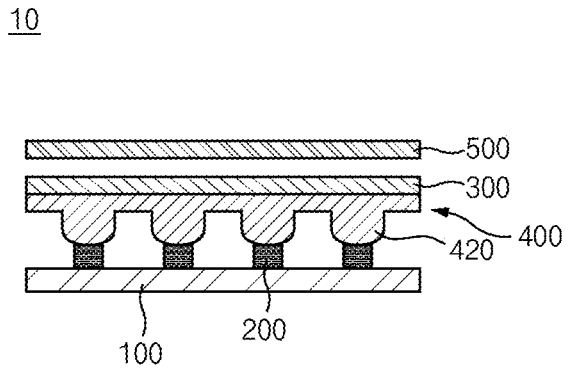
FIG. 5 is a cross-sectional view schematically illustrating a structure of a lamp for an automobile according to a third exemplary embodiment of the present disclosure.

FIG. 4 is a cross-sectional view schematically illustrating a structure of a lamp for an automobile according to a second exemplary embodiment of the present disclosure, and FIG. 5 is a cross-sectional view schematically illustrating a structure of a lamp for an automobile according to a third exemplary embodiment of the present disclosure.

As illustrated in FIGS. 1 and 4, according to the first exemplary embodiment and the second exemplary embodiment of the present disclosure, an inner lens 400 may be bonded to the top surface of a fluorescent layer 300 and provided between the fluorescent layer 300 and an outer lens 500. However, as illustrated in FIG. 5, according to the third exemplary embodiment of the present disclosure, an inner lens 400 may be bonded to the bottom surface of a fluorescent layer 300, and thus, the fluorescent layer 300 may be provided between the inner lens 400 and an outer lens 500.

Here, when the inner lens 400 is bonded to the top surface of the fluorescent layer 300 as in the first exemplary embodiment and the second exemplary embodiment of the present disclosure, a plurality of first protruding regions 410 may be provided on an upper region of the inner lens 400 as illustrated in FIG. 4. The plurality of first protruding regions 410 provided on the upper region of the inner lens 400 may be components that allow the lamp 10 to form a beam pattern having a predetermined design on the outside.

On the other hand, when the inner lens 400 is bonded to the bottom surface of the fluorescent layer 300 as in the third exemplary embodiment of the present disclosure, a plurality of second protruding regions 420 may be provided on a lower region of the inner lens 400 as illustrated in FIG. 5. The plurality of second protruding regions 420 provided on the lower region of the inner lens 400 may be components for enhancing optical efficiency by concentrating the light emitted from the plurality light sources 200. In order to efficiently concentrate the light, the plurality of second protruding regions 420 may face the plurality of light sources 200, respectively, as illustrated in FIG. 5.

Figure 6:
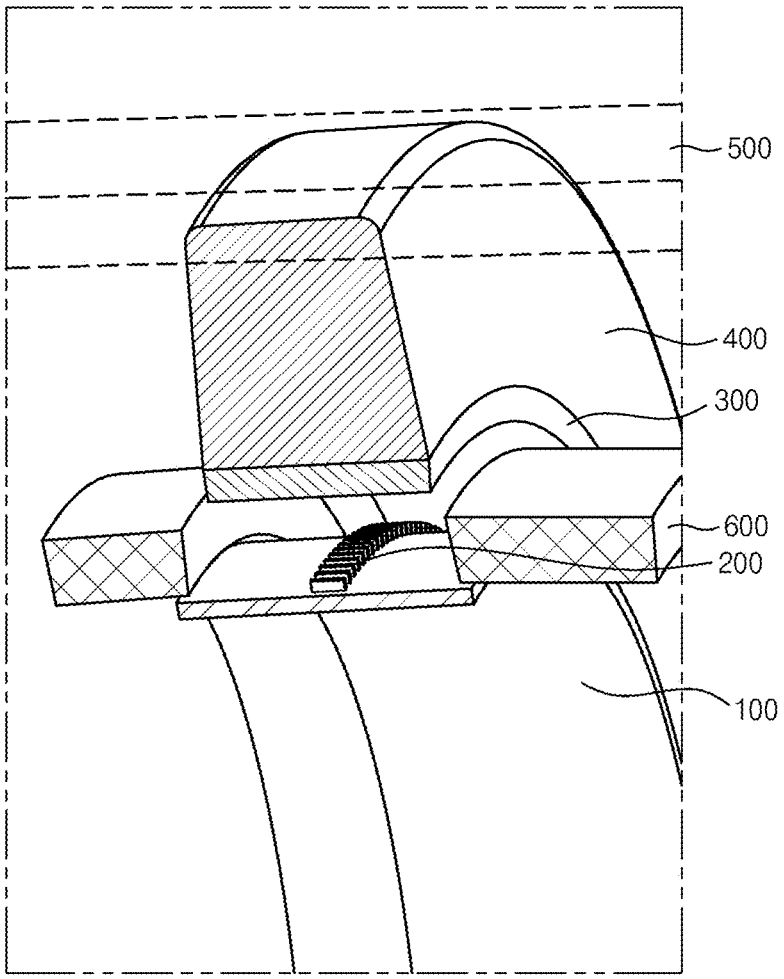
FIG. 6 is an enlarged perspective view illustrating a state in which a lamp for an automobile according to the present disclosure is cut.

FIG. 6 is an enlarged perspective view illustrating a state in which a lamp for an automobile according to the present disclosure is cut.

As illustrated in FIG. 6, according to the present disclosure, each of a substrate part 100, a fluorescent layer 300, an inner lens 400, and an outer lens 500 may have a curved shape in which a central region thereof protrudes outward.

Also, a lamp 10 may further include a bezel part 600 provided in a circumferential region on the substrate part 100. Here, the bezel part 600 may be provided such that the substrate part 100 interferes with the bezel part 600 when the substrate part 100 moves outward. More preferably, when the lamp 10 is viewed from above, the bezel part 600 may be provided such that at least a portion of the circumferential region of the substrate part 100 is covered by the bezel part 600.

Automobile

An automobile according to the present disclosure may include a lamp 10 for an automobile. Here, the lamp 10 may include: a substrate part 100; a plurality of light sources 200 provided in close contact with a top surface of the substrate part 100 and emitting light; a fluorescent layer 300 spaced upward from the substrate part 100 and the plurality of light sources 200 and including a fluorescent material; and an inner lens 400 provided in close contact with a top surface or a bottom surface of the fluorescent layer 300.

According to the present disclosure, the lamp for an automobile may be manufactured, which satisfies the various regulations required for the lamp even while achieving the more compact size and applying the various types of design compared to the related art.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for an automobile, the lamp comprising:

a substrate part;

a plurality of light sources provided in close contact with a top surface of the substrate part and configured to emit light;

a fluorescent layer spaced upward from the substrate part and the plurality of light sources and comprising a fluorescent material;

an inner lens provided in close contact with a top surface or a bottom surface of the fluorescent layer; and an outer lens provided above the fluorescent layer and the inner lens, wherein the outer lens selectively blocks a range of wavelengths of visible light emitted from the fluorescent layer or the inner lens, thereby generating visible light without the blocked range of wavelengths, wherein the range of wavelengths of visible light blocked by the outer lens is between 430 nm and 480 nm.

2. The lamp of claim 1, wherein the inner lens is bonded to the top surface of the fluorescent layer.

3. The lamp of claim 1, wherein the inner lens is bonded to the bottom surface of the fluorescent layer.

4. The lamp of claim 1, wherein the fluorescent layer further comprises a resin matrix, wherein the fluorescent material is dispersed within the resin matrix.

5. The lamp of claim 1, wherein a peak wavelength of light emitted from the fluorescent layer is greater than a peak wavelength of light emitted from the plurality of light sources.

6. The lamp of claim 1, wherein the light sources are exposed to an outside of the lamp.

7. The lamp of claim 2, wherein a plurality of first protruding regions are provided on an upper region of the inner lens.

8. The lamp of claim 3, wherein a plurality of second protruding regions are provided on a lower region of the inner lens.

9. The lamp of claim 8, wherein the plurality of second protruding regions face the plurality of light sources.

10. The lamp of claim 1, wherein each of the substrate part, the fluorescent layer, the inner lens, and the outer lens has a curved shape in which a central region thereof protrudes outward.

11. The lamp of claim 1, further comprising a bezel part provided in a circumferential region on the substrate part, wherein the bezel part is provided such that the substrate part interferes with the bezel part when the substrate part moves outward.

* * * * *